United States Patent [19]

Barnes et al.

[11] Patent Number: 4,672,684

[45] Date of Patent: Jun. 9, 1987

[54] THERMOPLASTIC BAG

[75] Inventors: John G. Barnes, Brampton; Charles R. Murray, Toronto, both of Canada

[73] Assignee: C I L, Inc., North York, Canada

[21] Appl. No.: 822,698

[22] Filed: Jan. 24, 1986

Related U.S. Application Data

[63] Continuation of Ser. No. 632,522, Jul. 19, 1984, abandoned.

[30] Foreign Application Priority Data

Oct. 6, 1983 [CA] Canada ..... 483484

[51] Int. Cl.[4] ..... B65D 30/06; B65D 30/26; B65D 33/01

[52] U.S. Cl. ..... 383/45; 383/102; 383/103

[58] Field of Search ..... 383/44, 45, 102, 103

[56] References Cited

U.S. PATENT DOCUMENTS

| | | | |
|---|---|---|---|
| 2,040,337 | 5/1936 | Rosmait . | |
| 2,084,296 | 6/1937 | Eustis | 383/102 |
| 2,593,328 | 4/1952 | Meaker . | |
| 2,774,402 | 12/1956 | Wikle . | |
| 3,085,608 | 4/1963 | Mathues . | |
| 3,095,023 | 6/1963 | Rang . | |
| 3,144,197 | 8/1964 | Milner . | |
| 3,195,283 | 7/1965 | Broersma | 383/66 |
| 3,237,844 | 3/1966 | Hughes . | |
| 3,430,842 | 3/1969 | Yamaguchi . | |
| 3,628,720 | 12/1971 | Schmedding . | |
| 3,706,410 | 12/1972 | Baker . | |
| 3,833,166 | 9/1974 | Murray | 383/44 |
| 3,937,395 | 2/1976 | Lawes | 383/45 |
| 3,989,182 | 11/1976 | Stearley . | |
| 4,026,460 | 5/1977 | May . | |
| 4,071,187 | 1/1978 | LaFleur . | |
| 4,073,429 | 2/1978 | Lawes | 383/44 |
| 4,132,347 | 1/1979 | Saito . | |
| 4,310,118 | 1/1982 | Kisida . | |

FOREIGN PATENT DOCUMENTS

| | | | |
|---|---|---|---|
| 550072 | 4/1956 | Belgium . | |
| 1486733 | 6/1969 | Fed. Rep. of Germany . | |
| 1401713 | 7/1975 | United Kingdom | 383/45 |
| 1436126 | 5/1976 | United Kingdom . | |

*Primary Examiner*—Stephen P. Garbe

*Attorney, Agent, or Firm*—Cushman, Darby & Cushman

[57] ABSTRACT

A thermoplastic shipping bag having a thermoplastic inner ply comprising a mesh which permits the packaging of finely powdered materials without releasing unacceptable levels of powders to the atmosphere during or after filling and without requiring significant modification to packaging systems used to fill and process multi-wall paper shipping bags.

11 Claims, 6 Drawing Figures

THERMOPLASTIC BAG

This is a continuation of application Ser. No. 632,522, filed July 19, 1984, which was abandoned upon the filing hereof.

BACKGROUND OF THE INVENTION

This invention relates to thermoplastic shipping bags and in particular to bags used for packaging fine powders of less than 100 microns.

Plastics shipping bags are suitable for the packaging, transportation and storage of a wide variety of products in granular, bead, or pellet form. However, there are many products such as cement, clays, powdered coal and pigments, for instance, which cannot be readily packaged in plastic bags because of the inability of plastic films to release enough of the air which has become entrained inside the package during the high-speed filling operation. Plastic bags are known having perforations directly in their walls to provide the necessary air release. However, this can result in excessive environmental contamination and/or product loss from the package. This means that for fine powdered products having a particle size in the range of 10 microns or less, resort is generally had to the use of paper or paper-like packaging materials for generally acceptable finished packages. Paper bags are commonly used for these applications with the inner ply of the paper supplying the necessary filtering action. Such packaging materials, however, are limited by the end use of these packaged goods in several ways.

One drawback is that paper bags are extremely sensitive to environmental extremes and require special care in high humidity or low temperature conditions. Also, paper fibre contamination may result when the package's contents are emptied into sensitive chemical mixtures. Further, with the growing concern for environmental safety in the workplace, there is an increasing need for packages which can be added to, and thermally or mechanically dispersed within, industrial processes. Multi-wall paper bags, and, to some degree, plastic bags using contaminating adhesives or glues are generally incompatible, particularly in the plastics and rubber industry.

Some of these problems can be overcome by using a plastic bag made from a spun bonded plastic in the form of a mat of compressed thermoplastic fibres, such as TYVEK TM, which has high strength characteristics while still retaining the air permeable characteristics of paper. Alternatively, a plastic film bag lined with paper achieves the same results. However, these bags have the disadvantage of high cost and, like paper bags, they have the further disadvantage of being unsuitable for use in applications where the bag as well as the product is thrown into rubber or plastic mixes where the bag is expected to mix and incorporate as part of the finished product.

One particularly useful type of plastics shipping bag is that known as a valved bag, which is generally used for packaging granular materials such as fertilizers and polymer resins. One such embodiment is described in our U.S. Pat. 3,833,166. These bags possess the important commercial advantage of being easily filled through a valve structure with the self-closing of this valve structure after filling. When filled and stored with the valve in the down or sealed position the effectiveness of the valve is so good that entrapped air is difficult to expel from the bags. To avoid the problem it is common practise to place a row of 10 or so 0.6 mm diameter perforations down each side of the bag to allow the air to escape. This is satisfactory for coarse granular product, but for fine powder materials of a practice size of less than 100 microns this practise is unsatisfactory since the product can readily leak through the holes in unacceptable amounts. This disadvantage is somewhat overcome by offsetting inner perforated layers of the bag from the outer perforated layers and trapping any escaping materials between the inner and outer layers of the bag while readily allowing the air to escape. However, the small number of perforated holes can somtimes clog, resulting in substantial air retention. For example, by using this system of offset perforations, typically with perforations at 2.5 cm centres over the entire body of the bag, product with particle size of down to 1.0 micron may be packaged. However, with powders of such small particle size, the product will flow into these few holes forming pyramidal plugs which prevent further flow of air from the bag.

SUMMARY OF THE INVENTION

It has now been that a suitable shipping bag can be obtained by providing the bag with a perforated wall and an inner lining of a thermoplastic mesh adjacent said perforated wall. This inner lining constitutes an inner lining for the bag which permits adequate filtering and air release during and after the filling operation while retaining most of the powdered product within the bag. While some of the mesh holes may be subject to pyramidal clogging, most holes will remain open permitting air to escape.

Accordingly, the invention provides a thermoplastic shipping bag having a front wall and a back wall characterized in that at least one of said walls is perforated to permit the passage of air therethrough, said perforated wall having adjacent thereto an inner lining comprising a thermoplastic mesh whereby said inner lining constitutes an inner lining of the bag which permits the escape of entrained air. Where the fine powdered products have a particle size of 100 microns or less, the inner mesh pore sizes are from 0.1 mm (100 microns) to 1.0 mm (1000 microns). Thus, the mesh openings are larger than the particles size. Some particles will escape through the inner mesh and most of these will be retained by the outer perforated wall. Minor amounts of the fine powder product may also escape from the outer wall, but not in unacceptable amounts.

The invention is of use when applied in the conventional open-top bag.

Accordingly, in one feature the invention provides a plastic shipping bag of the open-top type having a back wall and a front wall joined together around the periphery of the bag at its bottom and both sides characterised in that at least one of said walls is perforated to permit the passage of air therethrough, said perforated wall having joined around all or part of its periphery an inner lining comprising a thermoplastic mesh, whereby said inner lining constitutes a powdered product restraining inner lining of the bag having a mush opening size larger than the fine powder particle size.

The utility of the open-topped bag according to the invention resides in the fact that the bag may be filled with the upper inner opposing faces of the meshed lining and its opposing wall substantially contacting each other or the filler spout of the powder feeding machine. Entrained air may then escape through the thermoplastic mesh during the filling operation but mainly after the bag is sealed, with reduced product loss.

The invention is of particular use when applied in a valved bag.

Accordingly, in a preferred feature the invention provides a thermoplastic shipping bag of the valved bag type having a back wall and a front wall joined together around the entire periphery of the bag and a filling aperture characterised in that at least one of said walls is perforated to permit the passage of air therethrough, said perforated wall having joined thereto an inner lining comprising a thermoplastic mesh whereby said inner lining constitutes a powdered product restraining inner lining of the bag having a mesh opening size larger than the fine powder particle size.

In a more preferred feature the invention provides, a thermoplastics valved bag of the type having a back wall and a front wall joined together around the entire periphery of the bag, the front wall consisting of a first panel and a second panel, of greater combined width than the width of the back wall, said first panel at least partially overlapping said second panel throughout the length of the bag and said panels in their common area being joined together along a line substantially parallel with and at a distance from one end of the bag, thus forming a tubular self-closing filling sleeve having inner and outer walls and extending transversely of the bag adjacent to said one end thereof, with said first panel forming the outer wall and said second panel forming the inner wall of said filling sleeve, and being also joined together along at least one line extending from said first-mentioned line substantially to the opposite end of the bag, said second panel consisting of at least two plies that are non-coextensive with each other so that at least the inner end portion of the inner wall of said filling sleeve is formed of a number of plies that is less than the total number of plies in said second panel, characterised in that at least one of said walls is perforated to permit the passage of air therethrough, said perforated wall having joined thereto an inner lining comprising a thermoplastic mesh whereby said inner lining constitutes a powdered product restraining inner lining of the bag having a mesh opening size greater than the fine powder particle size.

The inner lining comprising a thermoplastic mesh is preferably joined to the perforated wall at the periphery of the wall. However, this inner lining may be joined by intermediate tack seals, spot welds or by adhesives at other selected places throughout the area of the perforated wall.

It can be readily seen that the advantages of the valved bag according to the invention reside in the fact that entrained air can exit through the mesh of the inner lining and vent to atmosphere through the perforated wall without losing unacceptable amounts of the fine powder product, instead of via the filling sleeve as the bag is being filled, and most important after the valve has self-sealed with entrained air still in the bag.

By the term "thermoplastic", as used herein is meant any polymeric material that will repeatedly soften when heated and harden when cooled which is capable of providing a film, ply, layer, or mesh of suitable thickness and strength for shipping bags. Of particular use are thermoplastics of the polyethylene and polybutadiene family of polymers. As examples, high density, low density, linear low density polyethylene, ethylene-vinyl acetate copolymers and 1,2 poly butadienes may be mentioned.

By the term "mesh" is meant an air porous film or ply having pores which constitute discrete regular or irregular apertures arranged in the form of a net or sieve. The mesh may generally be formed by the perforation of a hot thermoplastic film or by the weaving of a thermoplastic yarn.

It will be readily appreciated that the selected mesh pore size of use in the practice of the invention will be dependent upon the particle size of the powdered product for which the bag is used and that it is well within the skill of the art for a porous inner lining having pore sizes suitable for a particular product to be readily selected and manufactured. Generally, the pore size will be of a diameter of from 0.1 mm to 1.0 mm. A density of at least $5/cm^2$, is essential, preferably $>25$ pores/$cm^2$, and more preferably, 300 pores/$cm^2$ but may vary according to the particle size of the fine powder. The pores are of a size suitable to cause retention of most of the particular powdered product while permitting release of the entrained air.

As the pore density (number of pores/$cm^2$) increases the pore size is reduced to approach the desirable lower limit. However, provided the pore size is not of the size of a particular powdered product, such as to cause excessive pore blockage, pore sizes lower than 0.1 mm may be of use.

It has been found that the air filtering improvement which occurs as the pore density increases is much greater than would have been expected if due simply to the increase in the number of pores. It is believed that as the density of the pores increases such that adjacent pores become closer together pyramidal plugging formation is reduced by the turbulence of air flows through adjacent pores of the mesh.

Depending on the severity of product aeration of the material being poured into the bag, the thermoplastic mesh may constitute the entire and full inner lining or only some portion thereof. Preferably, for speed of air release through the mesh it constitutes the whole of the inner lining.

Generally, a bag according to the invention comprises a single inner lining comprising a mesh at one side only of the bag. However, it can be readily seen that both walls of the bag may each be perforated and joined to its respective inner lining. However, where a valved bag according to the invention has a meshed lining joined to the front wall of the bag, it is necessary that this lining be joined to the front wall in such a manner as to not prevent or hinder the entry of the powdered product into the bag proper, i.e. it must allow entry into the space between the back wall and the inner meshed lining. This can be achieved, for example, by having the lining joined to the front wall below the filling sleeve.

While both the front and back walls may be perforated, provided that the wall to which the inner meshed lining is joined is perforated, this is generally sufficient to effect air release. The perforations may take the form of holes and/or slits and the desired number, shapes, distributions, and sizes of the perforations in the wall will be determined by the strength and thickness of the heavy-gauge film and the volume of air to be released, but should not be such that the strength of the bag is unacceptably weakened. Optionally, the wall further consists of two heavy-gauge plies which are perforated together and subsequently separated and displaced so that the perforations of each ply are offset one to the other by a prescribed distance. Such an arrangement assists in reducing moisture ingress.

It should be understood that the principles of the invention are applicable also to the fabrication of bags having walls individually comprising more than one ply, e.g. two plies, three plies, four plies, etc. In general, however, the back and front walls have the same number of plies, preferably, two plies. The important feature is that in addition, one or both walls must also have an inner meshed lining associated therewith.

It will be understood that the term "inner lining" as used in this specification is not to be restricted solely to a lining which is adjacent to and contacts the powdered product when the bag is full, but also embraces that lining comprising a thermoplastic mesh which may be separated from the product by an interposed perforated ply.

Thus, also falling within the scope of the invention is a bag, as hereinbefore described, provided with an inner perforated film or ply which constitutes a true inner ply of the bag and contacts the powder product and which permits air and fine powder to exit via its perforations prior to this air and fine powder contacting the inner ply comprising a thermoplastic mesh.

It is not necessary for all plies and the inner meshed lining of the bag to be made of the same material. In the case of a two-ply bag it may be found advantageous to make the innermost ply of the perforated wall and the inner meshed lining of a plastics material that melts at a different temperature than the plastics material of the outermost plies. Such bags are particularly useful in applications in which materials such as, for example, crystalline or powdered chemicals or pigments, are packed into the bags while hot.

BRIEF DESCRIPTION OF THE DRAWINGS:

Three embodiments of the bag of this invention will now be more particularly described by way of example with reference to the accompaning drawings, in which.

Corresponding reference characters indicate corresponding parts throughout the several views of the drawings.

DETAILED DESCRIPTION OF THE PRESENTLY PREFERRED EXEMPLARY EMBODIMENTS

Figure 1:
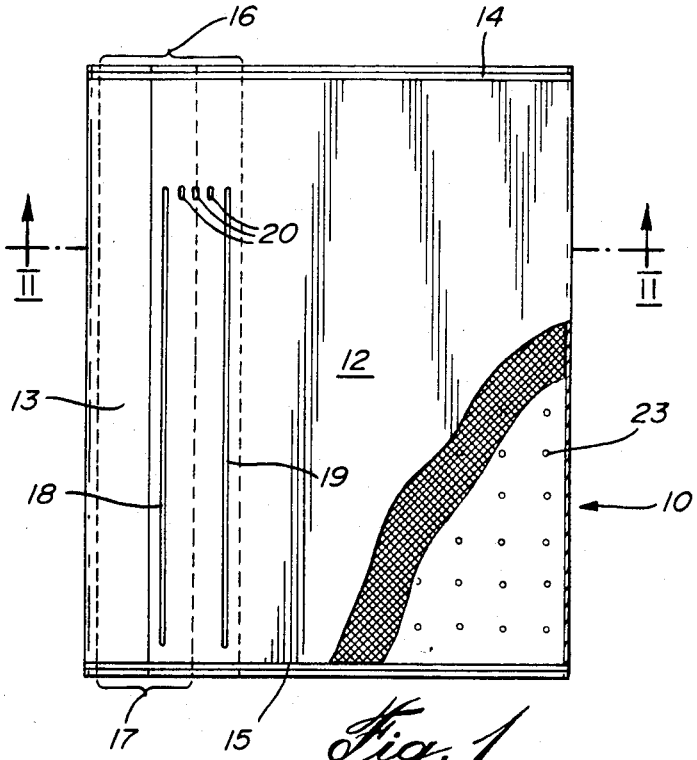
FIG. 1 is an elevational view of a first embodiment of a valved bag according to the invention.
Figure 2:
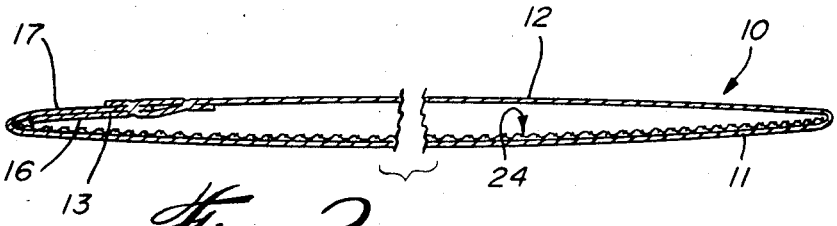
FIG. 2 is a sectional view along line II—II of FIG. 1.

In FIGS. 1 and 2 is shown a generally rectangular pillowtype bag 10, formed of heavy-gauge (6 mil) polyethylene film, and having a single-ply back wall 11 and a front wall made of first and second partially overlapping panels 12 and 13. Wall 11 has a multiplicity of perforations constituted as 0.6 mm diameter holes 23 at 2.5 cm centres over the wall's entire area. As shown, the first panel 12 is single-ply while the second panel 13 has two plies 16 and 17. Panel 12 and outer ply 17 of panel 13 are integral with back wall 11 and thus form with the back wall a flattened single-ply tube, which is closed at both ends by transverse seals 14 and 15. Panel 13 lies beneath panel 12 in the area of overlap, and the free edge of its inner ply 16 which is a strip of film extending the whole length of the bag and being somewhat wider than ply 17, projects somewhat beyond the free edge of outer ply 17. A seal 18 unites both plies of panel 13 with panel 12, and a seal 19 unites the projecting end of ply 16 of panel 13 with panel 12. The portion left unsealed in the common area of overlap at the top end of the bag constitutes a tubular valve sleeve suitable for insertion of a filling spout. The top ends of seals 18 and 19, together with dot seals 20 delineate the tubular valve sleeve. When the bag has been filled, the projecting end portion of the inner ply 16 of panel 13 acts as a sift-proof closing flap for the valve.

Also integral with back wall 11 at its inner periphery is an inner polyethylene mesh 24 of 1.25 mil thickness, having a pore density of 300 pores/cm$^2$ and pore size of 0.2 mm (200 microns) diameter, (formed from "VISPORE" TM film, ethylene-vinyl acetate (2%) copolymer, melt index of 0.3, - Ethyl Corporation).

In FIGS. 3 and 4 again is shown a generally rectangular pillow-type bag 10, formed of 3 mil polyethylene film. It has a two-ply back wall 21, each ply of which has a multiplicity of 0.6 mm diameter holes 23 at 2.5 cm centres over its entire width and area. The arrangement of holes in one ply is offset from the arrangement of holes in the outer ply. Back wall 21, at the inner periphery of its innermost ply, is integral with an inner polyethylene mesh 24 of 1.25 mil/ thickness ("VISPORE" film).

Bag 10 also has a front wall made of two-ply 3 mil polyethylene partially overlapping panels, the said first panel being shown at 22 and the second at 13. Panels 22 and 13 are integral with back wall 21 and thus form with the back wall a flattened two-ply tube, which is closed at both ends by transverse seals 14 and 15. Panel 13 lies beneath panel 22 in the area of overlap, and the free edge of its inner ply 16 projects somewhat beyond the free edge of its outer ply 17. A seal 18, unites both plies of panel 13 with the two plies of panel 22, and a seal 19, unites the projecting end of ply 16 of panel 13 with the two plies of panel 22. The portion left unsealed in the common area of overlap at the top end of the bag constitutes a tubular valve sleeve, suitable for insertion of a filling spout. The top ends of seals 18 and 19, together with dot seals 20, delineate the tubular valve sleeve. When the bag has been filled, the projecting end portion of the inner ply 16 of panel 13 acts as a siftproof closing flap for the valve.

Although in the particular embodiment of the invention described with reference to FIGS. 1 to 4, the end of the valve sleeve is shown as being formed out of a projecting portion of the inner ply 16 of panel 13, it should be understood that it can alternatively be formed by a portion of outer ply 17 projecting beyond the edge of inner ply 16. In other words, either one of plies 16 and 17 can project beyond the edge of the other to form the valve closing flap. Seal 19, while not being essential prevents the contents of the filled bag from entering the space between the panels, from which it might not be easily emptied. Dot seals 20 may be replaced by a continuous seal extending substantially parallel to transverse seal 14 from the top end of seal 18 to be inward edge of ply 16.

While, in the drawings, the valve opening of each bag is shown as being located close to one side of the bag, it should be understood that it can be located anywhere adjacent to the end seal 14 of the bag, provided that sufficient space is left between its inner mouth and the side of the bag facing it to allow insertion of a reasonably long filling spout and free delivery of filling material therefrom. Generally, it is preferred to arrange the front panels so that the valve opening is located within one vertical half of the bag, with the valve sleeve extending into or towards the other vertical half. The width of the wider front panel will not significantly exceed, and preferably is less than, the width of the back wall.

Figure 3:
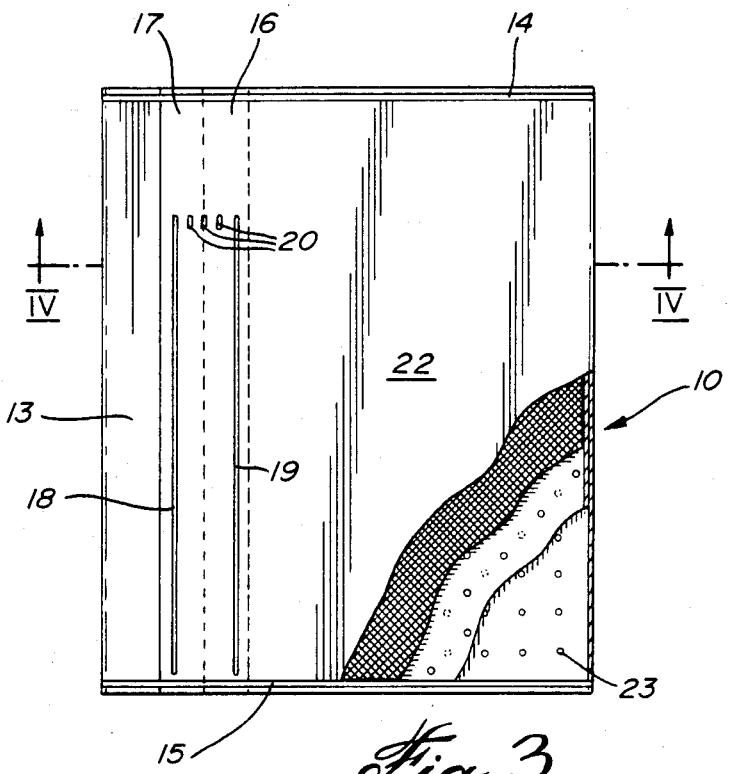
FIG. 3 is an elevational view of a second and preferred embodiment of a valved bag according to the invention.
Figure 4:
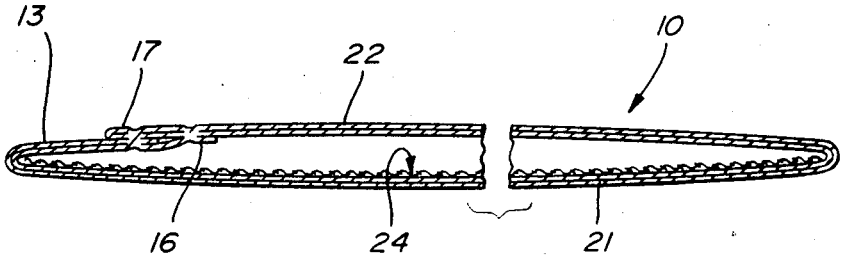
FIG. 4 is a sectional view along IV—IV of FIG. 3.

It is preferred that the longitudinal seals between the front panels, shown at 18 and 19 in FIGS. 1 and 3, stop short of and thus do not intersect transverse seal 15 at the bottom of the bag. Such intersection might result in weakening of the end seal at the points of intersection, and thus in weakening of the bottom of the bag.

The bags are preferably made from a thermoplastics tubular film of appropriate width. Preferably the plastics film is readily heat-sealable, or is provided with a heatsealable coating. Film of low-density polyethylene is particularly suitable because of its inherent heat-sealability, its toughness, and its low cost.

Bags according to the invention may be constructed by suitably incorporating a sheet of a thermoplastic mesh as an inner lining brought into contact with a sheet of suitably perforated heavy gauge film to produce a 2-ply structure composition, and subsequently folding opposite sides of the lengths of films inwardly so that the mesh component is contained with the edge portions overlapping one another. Heat sealing of the overlapping portions and the meshed lining film together along the length of the overlapping region and transverse of one of the open ends of the folded film provides the bag.

Figure 5:
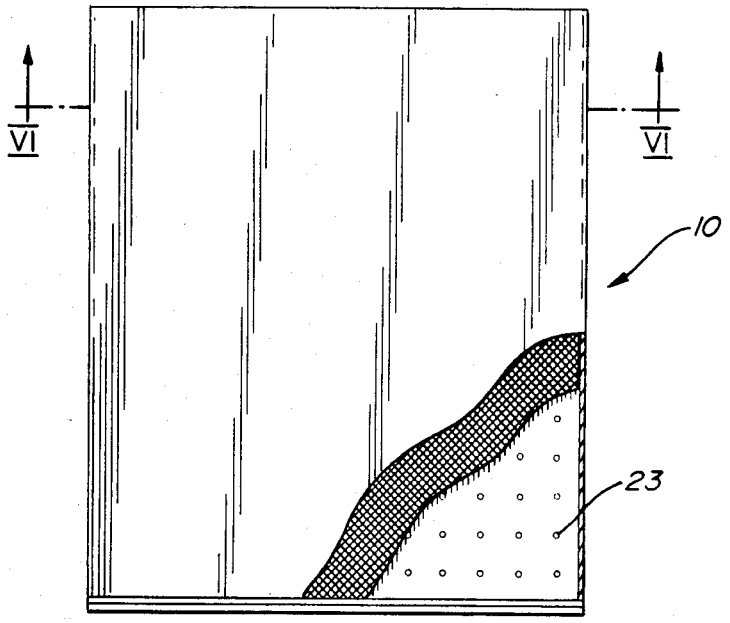
FIG. 5 is an elevational view of a third embodiment of an open-ended bag according to the invention.
Figure 6:
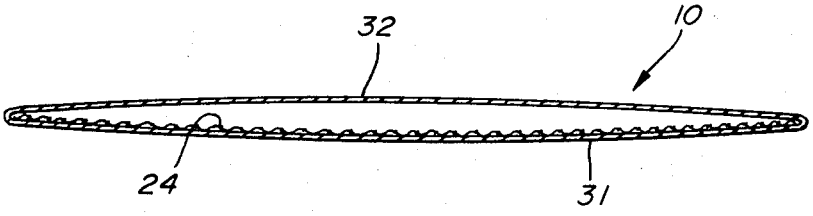
FIG. 6 is a sectional view along line VI—VI, of FIG. 5.

By employing analogous methods but sealing the over-lapped edges of the sheets along their whole length and making only a single transverse seal, a simple open ended bag can be constructed. Such a bag is shown in FIGS. 5 and 6, wherein a generally rectangular pillow-type bag 10, formed of heavy gauge (3 mil) polyethylene film comprises a single ply back wall 31 and a single ply front wall 32. The back wall 31 is perforated with a multiplicity of 0.6 mm diameter holes 23 at 2.5 cm centres over its entire area and has joined at its periphery an inner polyethylene mesh lining 24 having a pore density of 300 pores/cm$^2$, Where the object of the invention is a self-sealing bag, a section of the overlapping region will be left unsealed to constitute the valve opening and a second transverse seal made at the opposite end of the bag.

A preferred method of making a valved bag according to the invention is that described in U.S. Pat. No. 3,812,769 suitably modified in that a sheet of a thermoplastic mesh film is fed jointly with the heavy gauge-film to the fabricating machine described therein. It is advantageous to unite the thermoplastic mesh and heavy-gauge films as the latter passes from rollstock to the point of folding and bagmaking, for reasons which are apparent to those versed in the art. However, this modification can also be done suitably well at a point where the heavy-gauge film is passing by from its point of manufacture, or on separate machines adequately redesigned to facilitate the hot-air sealing stage and the drawing of plastic films from rolls rotating freely to a point where film can again be accumulated on rolls.

The bags may be constructed from one or more plies of film. When constructed of two-ply film, it is convenient to employ a length of flattened tubing as the starting heavygauge film rather than two separate single-ply lengths placed in contact.

The thermoplastic mesh constituting the inner lining can be made from a thermoplastic film by several techniques. Hot micro-perforation of the film by hot air jet, laser or needle perforation is preferred, while the weaving of thermoplastic yarns is optional.

A preferred inner lining consists of an ethylene-vinyl acetate copolymer CIL "633" TM EVA copolymer in the form of a mesh. However, because of the elastic nature of this film, with its inherent loss lateral strength as a result of such modification, it cannot be readily processed on high-speed shipping bag manufacturing equipment. It is desirable therefore to unite this film to the heavy-gauge film to facilitate passage over a suitable folding frame to complete the bag-making operation.

There are several methods by which the heavy-gauge and meshed films can be combined. They can be combined by contacting the films with a resistance-type heating element, or through the use of contact adhesives, or, preferably, because of the relatively thin and temperature sensitive nature of the meshed film by heat sealing with a hot air jet. The heat seals resulting from hot air jets are optionally made at the margins of the inner lining, continuously along its length, and additional seals running parallel with and inside these margins as necessary to marry this film to the heavy film preparatory to folding.

Perforation of the heavy-gauge film constituting the perforated wall may be done using mechanical perforators, on all or any part of the film surface, preferably, prior to its incorporation with the meshed film. Optimally, two heavygauge plies are used, which are perforated together and subsequently separated so that the perforations of each ply are offset to the other by a prescribed distance, continuously along the length of film. This provides the additional benefits of a reduction in moisture ingress or other environmental contamination of the contents, thereby increasing shelf life, and further reduces loss of packaged product to the atmosphere.

In an alternative embodiment the perforated wall of the bag has perforations adjacent its outer edge only.

It has been demonstrated that a preferred thermoplastic valved bag according to the invention and described herein would deaerate, after being sealed, in an equivalent amount of time, generally of the order of 30 seconds, as a typical multi-wall paper bag. In contrast, a conventional thermoplastic valved bag would require an indefinite time period to deaerate after normal industrial filling speeds for cementitious products; while a similar bag with simple perforations made directly through its walls would have improved deaeration but with excessive product loss and environmental contamination.

We claim:

1. A thermoplastic shipping bag for shipping powder, comprising:

a powder having a particle size less than or substantially equal to 100 microns;

a front wall and a back wall substantially surrounding said powder, at least one of said walls being perforated; and an inner lining disposed adjacent the perforated wall, said inner lining including a thermoplastic mesh having a pore size which is greater than the particle size of said powder.

2. A shipping bag according to claim 1 wherein said thermoplastic mesh has more than 5 pores per $cm^2$.

3. A shipping bag according to claim 1 wherein said thermoplastic mesh has more than 25 pores per $cm^2$.

4. A shipping bag according to claim 1 wherein at least one of said front wall and back wall includes valve means for providing a valve entrance to said shipping bag.

5. A shipping bag according to claim 1 wherein said inner lining includes a first thermoplastic mesh disposed adjacent said front wall, and a second thermoplastic mesh disposed adjacent said back wall.

6. A thermoplastic shipping bag of the open-top type for containing a powder, comprising:

a powder having an average particle size substantially equal to or less than 100 microns;

a front wall and a back wall joined together at a bottom and two sides of a periphery of said bag, at least one of said walls being perforated; and an inner lining disposed adjacent said at least one perforated wall, said inner lining including a thermoplastic mesh having a pore size greater than the particle size of said powder.

7. A shipping bag according to claim 6 wherein said thermoplastic mesh has more than 5 pores per $cm^2$.

8. A shipping bag according to claim 6 wherein said thermoplastic mesh has more than 25 pores per $cm^2$.

9. A thermoplastic shipping bag for shipping fine powder, comprising:

a fine powder having a particle size less than or substantially equal to 100 microns;

a front wall and a back wall substantially surrounding said powder, said front wall and back wall joined together at a bottom and two sides of a periphery of said bag, at least one of said walls being perforated;

a filling aperture located in at least one of said wall and said back wall; and an inner lining disposed adjacent the perforated wall, said inner lining including a thermoplastic mesh having a pore size which is than the particle size of said powder.

10. A thermoplastic bag for shipping a fine powder product, said bag having a length, a width, and a periphery, comprising:

powder having a particle size less than or substantially equal to 100 microns;

a front wall and a back wall joined together around said bag periphery, at least one of said front wall and said back wall being perforated, said front wall having a first panel and a second panel, a combined width of said first and second panels being greater than said bag width, said first panel partially overlapping said second panel to form a common area extending the length of said bag, said first and second panels being joined together in said common area to form a tubular filling sleeve extending transverse to said bag width; and an inner lining disposed adjacent the perforated wall, said inner lining including a thermoplastic mesh having a pore size which is greater than the particle size of said powder.

11. A thermoplastic shipping bag for shipping a fine powder product, said bag having a length, a width, and a periphery, comprising:

a powder having an average particle size substantially equal to or less than 100 microns;

a front wall and a back wall joined together around said bag periphery, at least one of said front wall and said back wall being perforated, said front wall having a first panel and a second panel, said first panel and said second panel having a greater combined width than said bag width, said first panel partially overlapping said second panel to form a common area extending said length of said bag, said first and second panels in said common area being joined together along a line substantially parallel with one end of said bag thus forming a tubular self-closing filling sleeve having inner and outer walls, said first panel forming said outer wall and said second panel forming said inner wall of said filling sleeve, said inner wall of said filling sleeve having an inner end portion, said second panel having two plies that are non-coextensive with each other; and an inner lining joined to the perforated wall around said bag periphery, said inner lining including a thermoplastic mesh having a pore size which is greater than the particle size of said powder.

* * * * *